United States Patent [19]

Maccaferri

[11] Patent Number: 4,775,271

[45] Date of Patent: Oct. 4, 1988

[54] ROBOT DEVICE FOR LOADING AND UNLOADING SPOOLS IN WIRE WINDING MACHINE

[75] Inventor: Angelo Maccaferri, Bologna, Italy

[73] Assignee: S.A.M.P. S.p.A. Meccanica di Precisione, Bologna, Italy

[21] Appl. No.: 885,630

[22] Filed: Jul. 15, 1986

[30] Foreign Application Priority Data

Jul. 17, 1985 [IT] Italy ..... 12540 A/85

[51] Int. Cl.[4] ..... B65H 1/00

[52] U.S. Cl. ..... 414/225; 414/736; 414/751; 242/25 A; 242/35.5 A; 57/268; 57/275; 901/46

[58] Field of Search ..... 414/225, 751, 736, 222; 242/25 A, 35.5 A, 172, 173; 57/281, 270, 268, 266, 275, 276, 278; 294/119.1, 907; 901/46

[56] References Cited

U.S. PATENT DOCUMENTS

| | | | |
|---|---|---|---|
| 3,670,912 | 6/1972 | Dunbar | 294/119.1 X |
| 3,778,996 | 12/1973 | Olson et al. | 57/278 X |
| 3,905,632 | 9/1975 | Caylor et al. | 294/119.1 |
| 4,165,585 | 8/1979 | Ishida et al. | 57/268 |
| 4,344,220 | 8/1982 | Sachot | 414/736 X |
| 4,351,494 | 9/1982 | Schippers et al. | 57/270 X |
| 4,439,090 | 3/1984 | Schaefer | 414/751 X |
| 4,558,506 | 12/1985 | Kielma | 414/736 X |
| 4,610,404 | 9/1986 | Maccaferri | 242/35.5 A X |
| 4,628,686 | 12/1986 | Tone et al. | 57/278 X |
| 4,637,564 | 1/1987 | Hallenbeck et al. | 242/35.5 A X |

FOREIGN PATENT DOCUMENTS 0110275 6/1984 European Pat. Off. .

*Primary Examiner*—Robert J. Spar
*Assistant Examiner*—Jennifer L. Doyle
*Attorney, Agent, or Firm*—Pollock, Vande Sande & Priddy

[57] ABSTRACT

A robot device for loading empty spools (b) and the unloading of filled spools (b') into and from wire winding machines arranged in a single file on one side of a path (4). The longitudinal axis of the path (4) is substantially parallel to the winding axes of the wire winding machines. The robot device comprises a transport carriage (2) movable along the path (4) and carrying a vertical supporting structure (1) on which is cantilevered a turret-like gripping frame (41–55) having an axis of rotation (10) which is horizontal and parallel to the path (4) and carries at least one pair of diametrically opposite self-centering clamps (P, P'), each clamp being adapted to grip a spool (B, B') the axis of which is parallel to the rotational axis (10) of the gripping frame (41–55), by clamping the end flanges of the spool (B, B'). Rotational (16, 17), locking (21–23) and displacement elements (30, 36) maintaining the gripping frame (41–45) with its clamps (P, P') on a horizontal plane rotate it around its axis of rotation and displace it horizontally parallelly to the axis of rotation so as to bring a clamp (P, P') to the side of the robot facing the winding machine and to move it towards and away from the winding machine.

8 Claims, 7 Drawing Sheets

ROBOT DEVICE FOR LOADING AND UNLOADING SPOOLS IN WIRE WINDING MACHINE

SUMMARY OF THE INVENTION

This invention relates to a robot device capable of serving automatically, one by one, a plurality of wire-winding machines arranged in a single file at one side of a guide track whereon said robot is slidably mounted, for the purpose of automating completing the loading and unloading steps of the empty spools and of the filled spools, respectively, into and from said winding machines, and to automate the steps of cutting the wire and of securing the leading and trailing ends of said wire to said spools. The robot device of the invention is adapted to operate with conventional wire-winding machines having either similar or different characteristics, i.e., operating on spools having either the same or different diameters, without requiring any modification of said wire-winding machines. The robot is further characterized by its simple construction and high technological reliability.

BRIEF DESCRIPTION OF THE DRAWINGS

These and other features of the invention, and the advantages resulting therefrom, will be apparent from the following description of a preferred embodiment thereof, shown as a non-limiting example in the drawings, wherein.

DESCRIPTION OF PREFERRED EMBODIMENT

Figure 1:
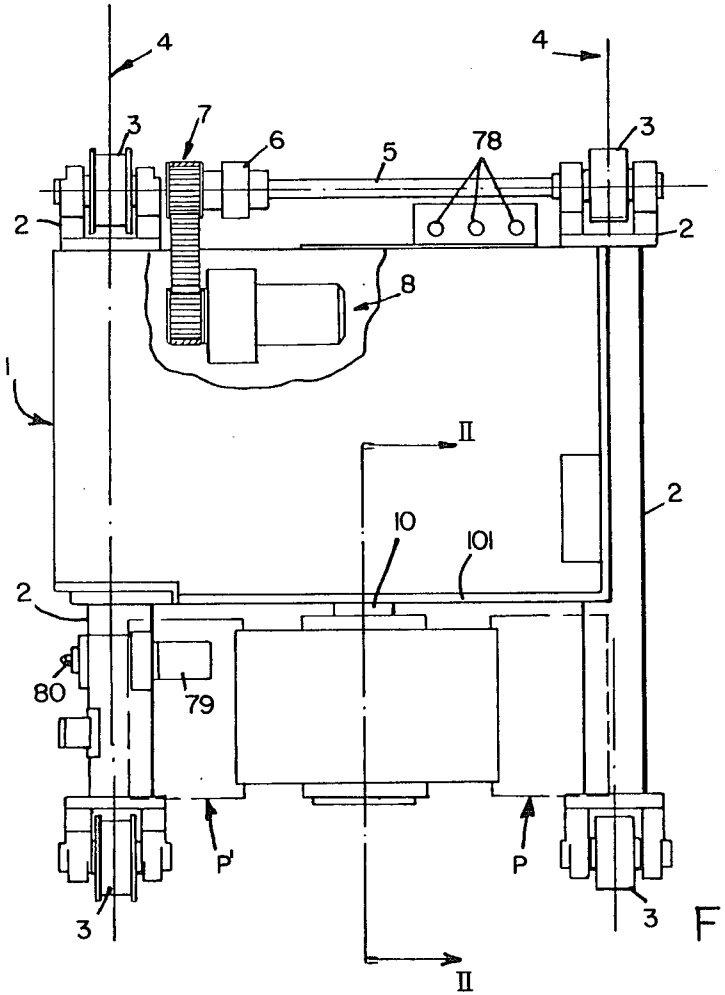
FIG. 1 is a top plan view of the robot, the means for cutting the wire and for securing the leading and trailing ends of the wire to the spool having been omitted for the sake of clarity.

With reference first to FIG. 1, it will be seen that the robot device comprises a parallelepiped-shaped box structure 1 with its longer dimension disposed vertically, provided at the bottom with a carriage 2 which, by means of wheels 3, some of which are flanged wheels, moves on a rectilinear horizontal track 4. Arranged in a single file at one side of said track are conventional wire-winding machines in which the axes of rotation of the spools are parallel to said track 4 and are located in a common horizontal plane. These wire-winding machines are of the type that is capable of effecting, by its own means, the locking of an empty spool between its center and tailstock members, and then of releasing a filled spool therefrom. The reservoir with the filled spools and with the empty spools may be located, for example, adjacent at least one of the ends of the track 4, at a station where said robot is usually parked and set up to serve the winding machine that, in turn, completes its operative cycle. Two opposite wheels of the carriage 2 are keyed to a common shaft 5 which, through a flexible coupling 6 and a positive drive unit 7, is connected to a DC electric motor 8 capable of rotating in opposite directions and suitably mounted on said carriage 2. Arranged within the structure 1 are all the means for actuating the robot, whereby the latter needs only to be fed with electric current and to be connected through the required cables to the stationary programming, controlling and checking console, not illustrated herein as unnecessary for understanding the invention.

Formed in the front side 101 of the structure 1 there is a transverse, horizontal, rectilinear slot 9 (FIGS. 2 and 8) loosely receiving therethrough a shaft 10 which is parallel to the track 4 and lies in the same imaginary horizontal plane as the axes of rotation of the center and tailstock systems of the winding machines to be served. The portion of the shaft 10 within the structure 1 is rotatably supported, through bearings 11 (FIG. 4), by a body member 12 carrying integrally a pair of parallel and horizontal bushes 112, 112', which are normal to the shaft 10 and which, through precision bearings, slide longitudinally on respective guide rods 13, 13' which are secured at their ends to plates 14 14' which, in turn, are secured to the inner face of the wall 101. The members just described are so sized that the shaft 10 can move horizontally over the length of the slot 9. The slot 9 is closed by rectilinear brush bristles 15 15' (FIGS. 2) which are secured to the inner face of the wall 101 so as to prevent any dust and foreign matter from entering the structure 1, while permitting the shaft 10 to move horizontally as required.

Figures 3, 6:
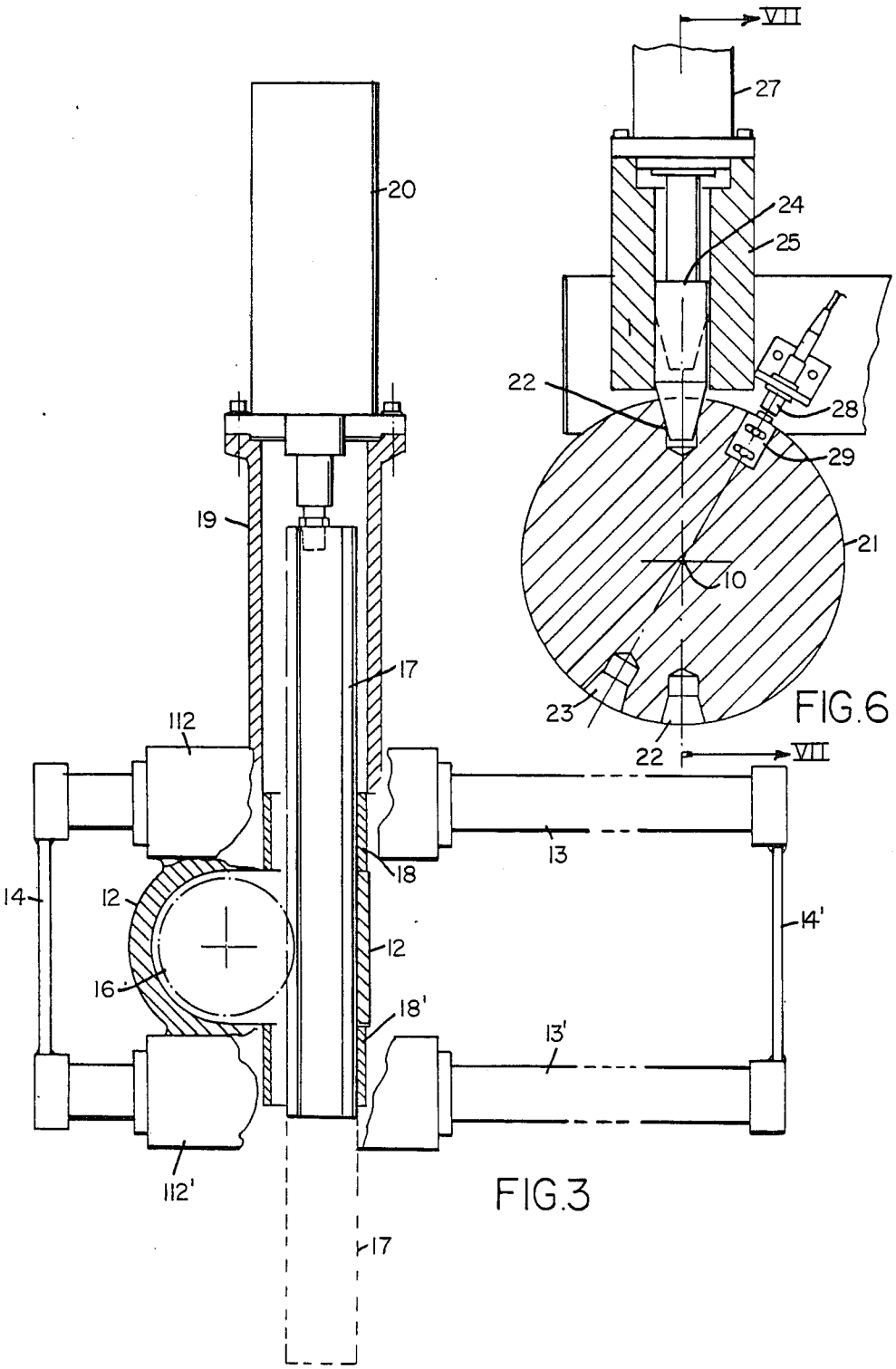
FIG. 3 shows some details of the assembly of FIG. 2, as seen from the section line III—III.
FIG. 6 is a sectional view on the line VI—VI of a further detail of the unit of FIG. 2 and 5.
Figures 4, 11:
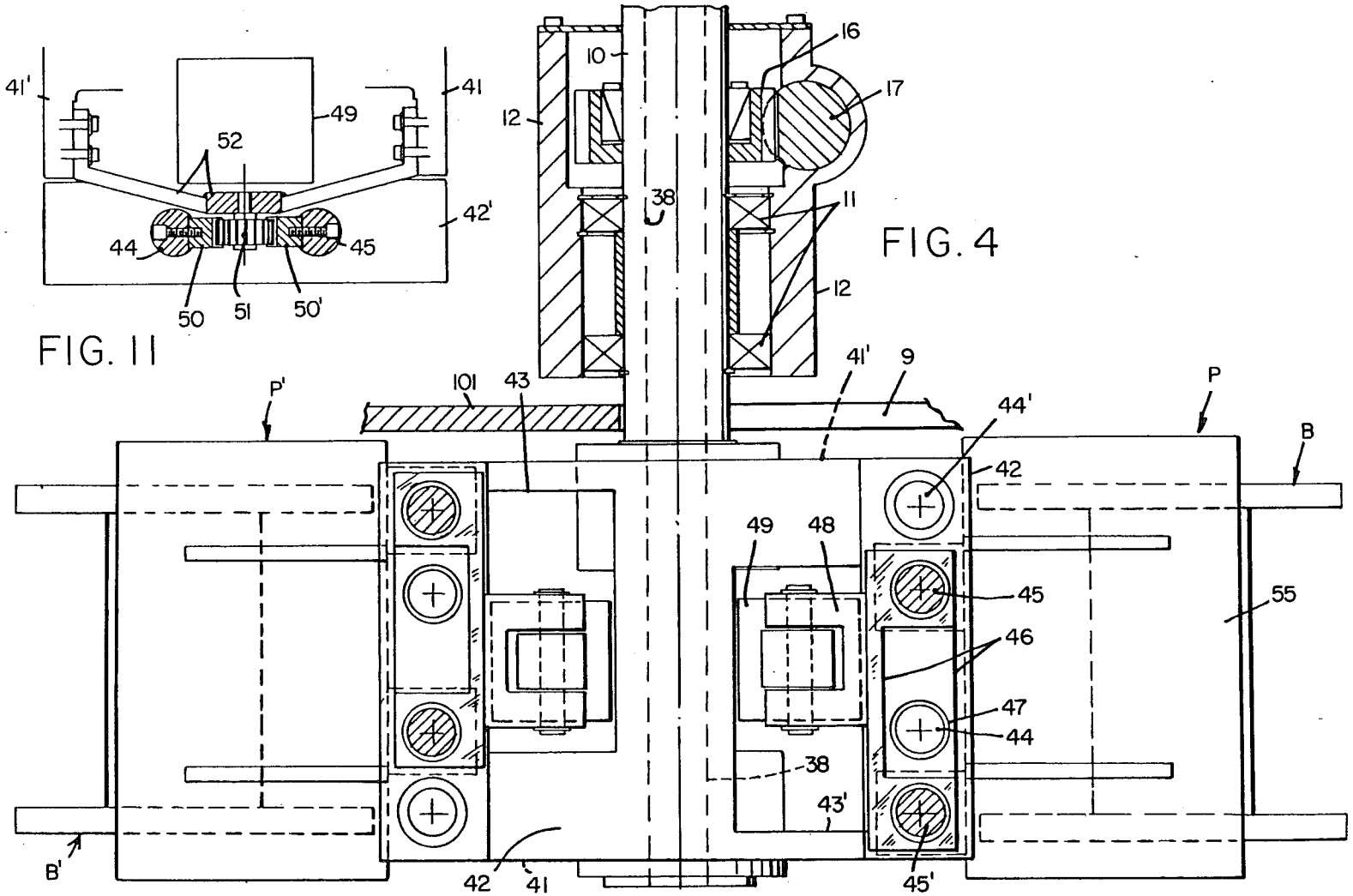
FIG. 4 is a top plan view of the horizontal-axis turret-like gripping frame carrying the clamps for gripping the spools, and shows the unit of FIG. 2 as seen from section line IV—IV.
FIG. 11 shows some constructional details of the turret-like gripping frame, as seen from section line XI—XI of FIG. 10.

FIGS. 3 and 4 show that, keyed on the portion of shaft 10 engaged within the body member 12, there is a toothed wheel 16 in tangential mesh with a rack 17 formed on a round-section rod which, in turn, is slidably mounted within guide bearings 18 18' which are secured to said body member 12. Co-axially secured to one of said bearings is a tubular member 19 mounting at the other end thereof the body of a fluid-operated, double-acting cylinder and piston unit 20, the piston rod of said unit being connected to one of the ends of said rack 17.

Figure 7:
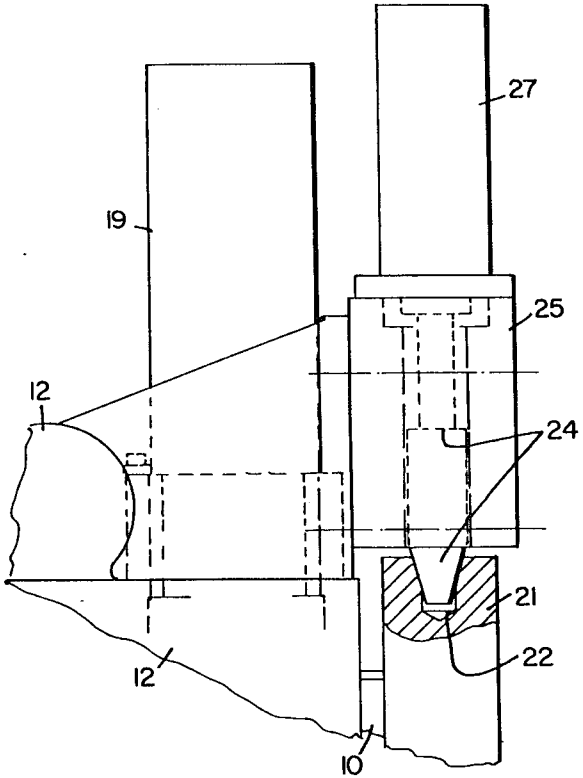
FIG. 7 shows the detail of FIG. 6, as seen from section line VII—VII.
Figure 5:
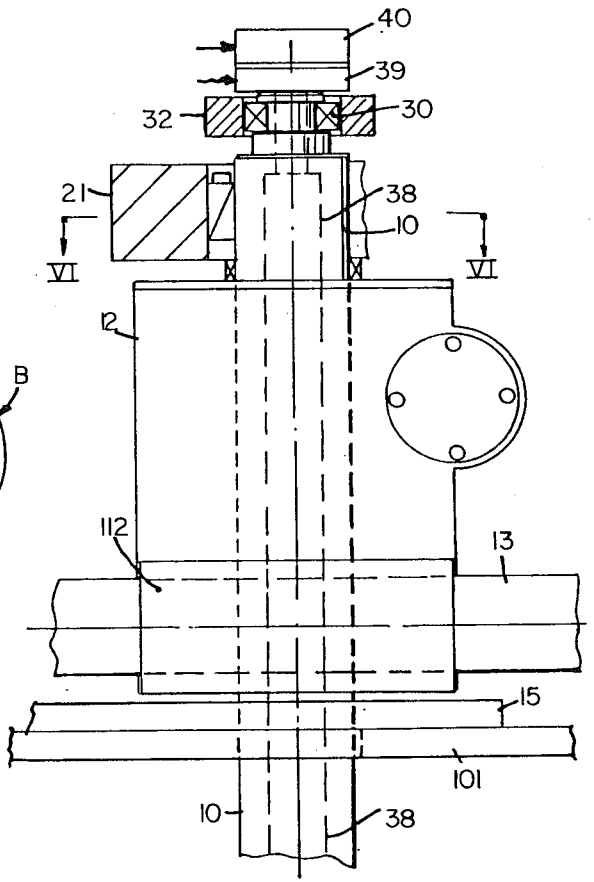
FIG. 5 is a top plan view of the unit of FIG. 2, some parts being shown in section.

With reference also to FIGS. 5, 6 and 7, it will be noted that keyed on the portion of shaft 10 protruding from the body member 12 and located within the structure 1, is a round-section drum 21 on the cylindrical surface of which there are formed two radial holes 22

22' angularly spaced apart by 180° and a third hole 23 with a 30° angular spacing from one of said holes. Said holes 22, 22' and 23 have a partly conical configuration and are designed to cooperate with a correspondingly-shaped plug member 24 slidably mounted in a guide 25 which is fixed to said body member 12. Fixed on the guide 25 is the body of a fluid-operated, double-acting cylinder and piston unit 27 the piston rod of which is connected to said plug member 24. Mounted on the body of the unit 20, which rotates the shaft 10, are magnetic sensors (not shown) which detect the position of said piston and, therefore, the angular position of said shaft 10. When the shaft 10 is rotated under the action of the unit 20, the sensor 28, through the reference means 29 on the drum 21, causes a decrease in the feeding pressure of said unit 20, so as to slow down the rotation of the shaft 10. When one of the magnetic sensors on the cylinder unit 20 is activated, the cylinder and piston unit 27 is actuated so that the plug member 24 will engage the cylindrical surface of the drum 21.

When the plug member enters one of the holes 22—22' or 23, a magnetic sensor on the cylinder 27 causes the feeding of the rotation unit 20 to be discontinued, whereby the robot may proceed to the successive operative steps.

Figure 2:
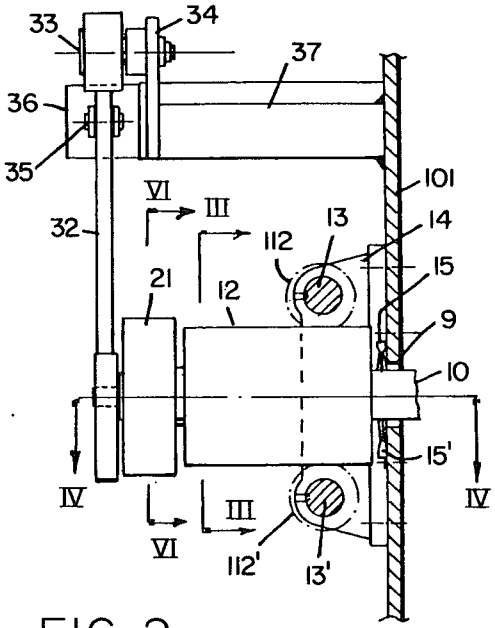
FIG. 2 shows some details of the robot, as seen from section line II—II of FIG. 1.
Figure 8:
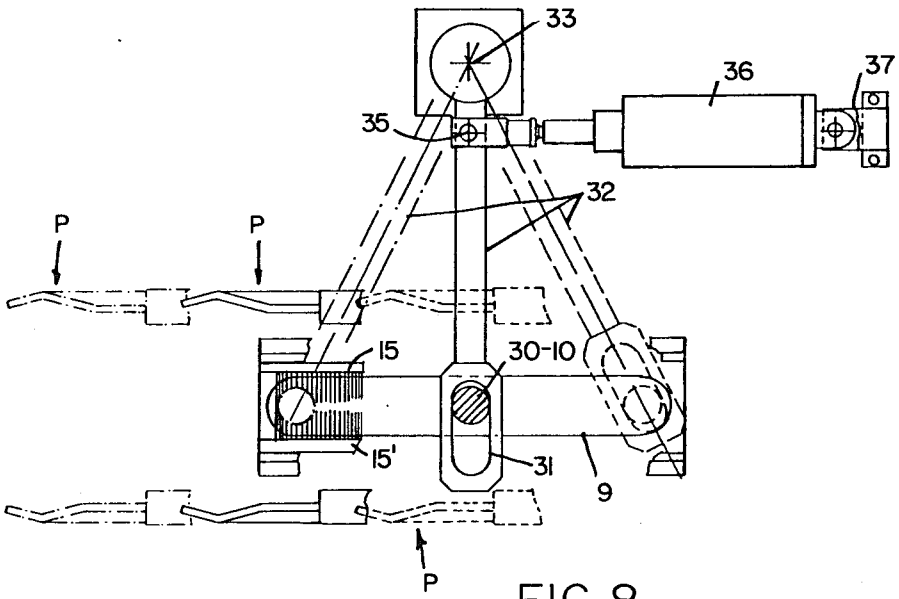
FIG. 8 is a rear elevational view of the assembly of FIG. 2.

FIGS. 2, 5 and 8 show that the end portion of the shaft 10, within the structure 1, is provided with a bushing 30 co-operating with a rectilinear longitudinal slot 31 formed in the end portion of a lever 32 which is directed upwards and is pivoted at its upper end to a hub 33 which is parallel to said shaft 10 and is supported by a structure 34 secured to the wall 101.

Pivoted at 35 to an intermediate point of the lever 32 is the piston rod of a fluid-operated double-acting cylinder and piston unit 36 the body of which is secured to a structure 37 which, in turn, is secured to the wall 101.

Upon activation of the cylinder and piston unit 36 to extend or to retract its piston rod, the shaft 10 is moved horizontally and may reach the ends of the slot 9, as shown in FIG. 8 in broken lines and with dot-and-dash lines, respectively.

The shaft 10 is axially hollow, as indicated at 38 in FIGS. 4 and 5, to receive therethrough the pressurized fluid ducts and the electric wires for operating the gripping frame which is mounted on the portion of the shaft 10 protruding out of the structure 1. Inasmuch as the shaft 10 rotates reciprocatingly through a maximum extent of 210°, the ducts and wires received axially through said shaft 10 will be submitted to only a small torsion which can safely be tolerated by said ducts and wires by virtue of their elasticity. It is to be understood, however, that said stress may also be eliminated by connecting said ducts and wires to a rotary coupling and to a slip-ring, respectively, arranged on the rear end of the shaft 10, as shown diagrammatically at 39 and 40 in FIG. 5.

Figure 9:
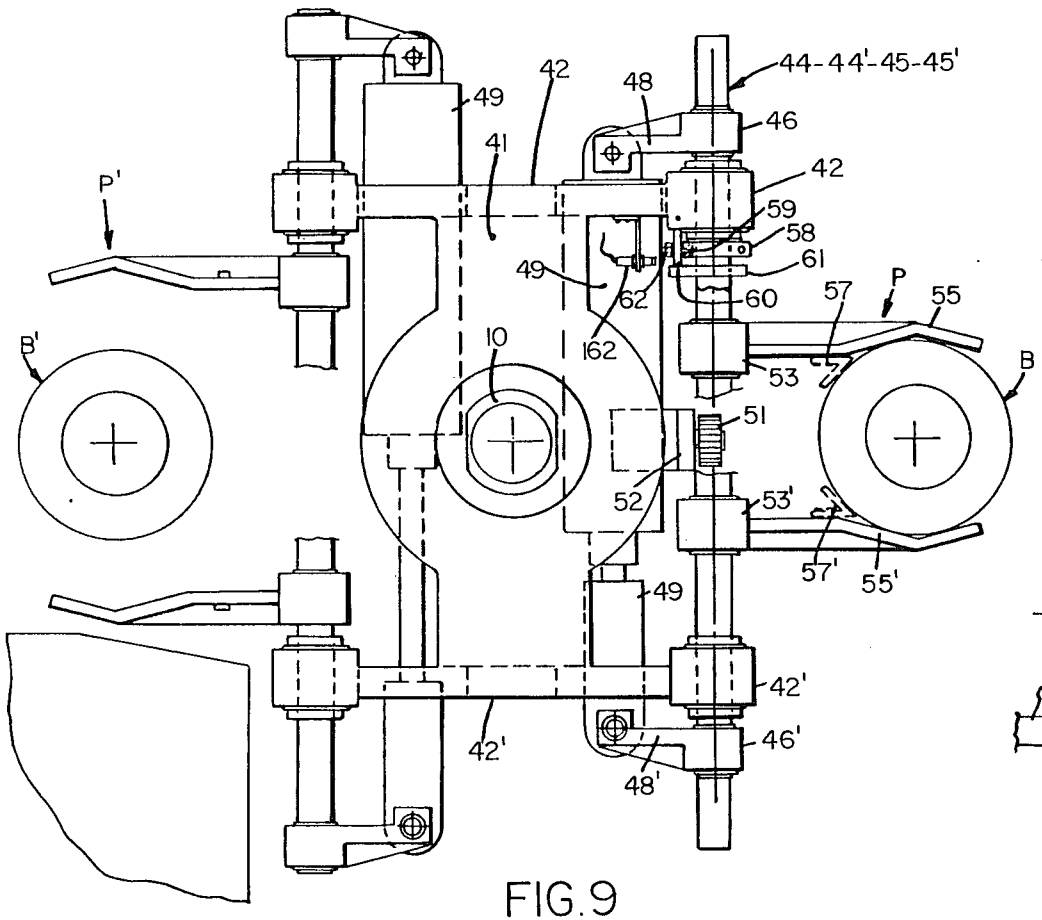
FIG. 9 is a front elevational view of the turret-like gripping frame with the spool-gripping clamps, during an intermediate operative step.
Figure 10:
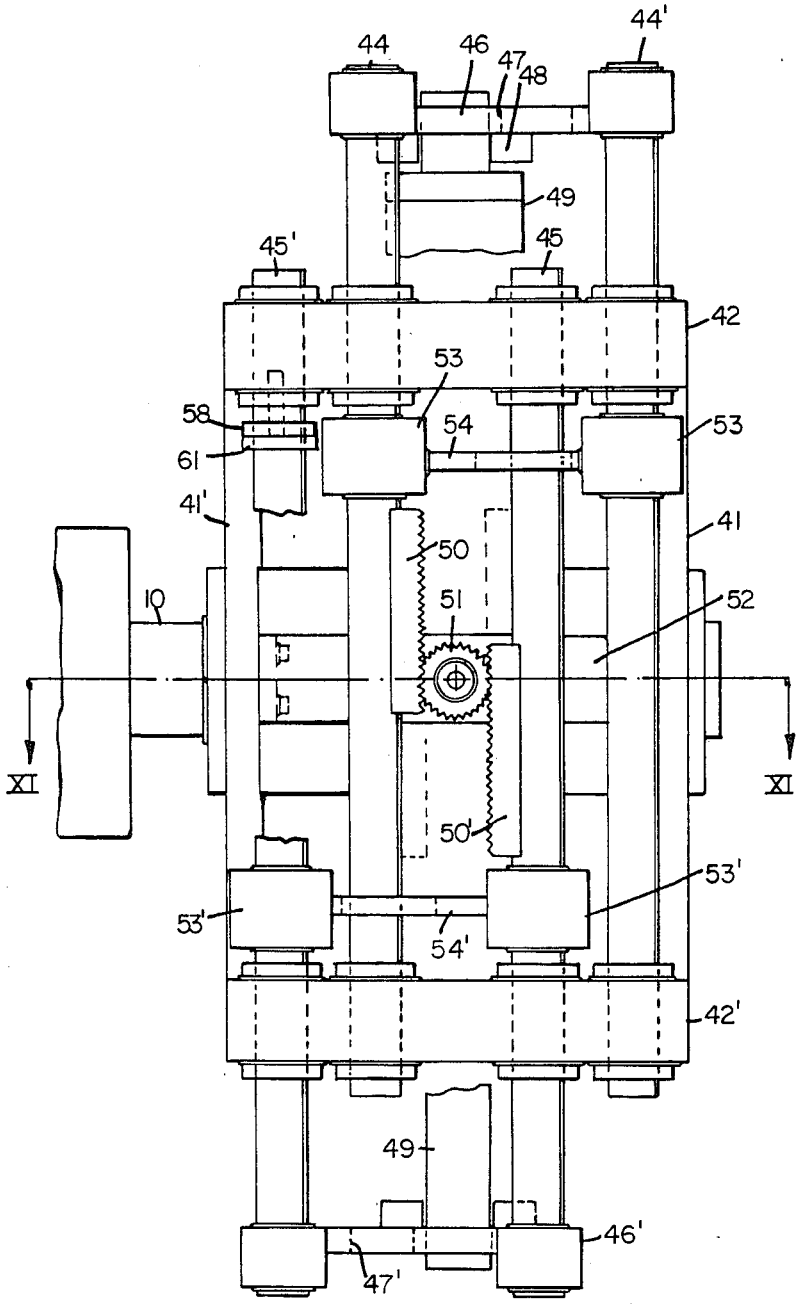
FIG. 10 is a side elevational view of the turret-like gripping frame, with one of the clamp-carrying units in the opened condition thereof.

With reference to FIGS. 4, 9 and 10, the turret-like frame with gripping clamps, mounted on the portion of the shaft 10 protruding from the structure 1, will now be described. This unit comprises a frame comprising two equal, parallel, substantially "I"-shaped plates 41—41' which are secured to the shaft 10 at their central region and normally thereto, said plates interconnected at their ends by means of further plates 42, 42', each of which is formed with asymmetric openings 43, 43'. At each side of the plates 42, 42', which is parallel to the shaft 10, there are formed four aligned holes axially slidably supporting, on each side of the frame formed by the plates 41, 41' and 42, 42', four equal rods 44, 44' and 45, 45' lying with their axes on a single imaginary plane which is vertical when the robot is at rest, said rods being normal to the shaft 10. For the sake of simplicity, only one of the clamping equipments, including the rods 44, 44' and 45, 45', will be described, in that said equipments are completely identical. It will be noted in FIGS. 4, 9 and 10 that the rods 44, 44' are secured, at their ends protruding from the plate 42, to a transom 46, while the ends of the rods 45, 45' protruding from the plate 42' are secured to a similar transom 46', the transoms 46, 46' being formed with holes 47, 47' to receive therethrough the ends of the rods 44, 45 which otherwise would interfere with said transoms. The transoms 46, 46' are secured to supports 48, 48' having affixed thereto the piston rod and the body, respectively, of a fluid-operated double-acting cylinder and piston unit 49.

Longitudinally secured intermediately of the rods 44, 45 are mutually similar racks 50, 50' in mesh with a common gear wheel 51 which is freely rotatably mounted on a support 52 secured to the plates 41, 41' (see also FIG. 11). On the portions of the rods 44, 44' and 45, 45' located between the plates 42, 42' there are secured, by pairs of locking collars 53, 53' and respective transoms 54, 54', gripping jaws 55, 55' the inner side of which is of concave configuration such as to clamp with precision the spools B at their end flanges holding them parallel to the shaft 10. The transoms 54, 54' are formed with holes permitting the rods 45 and 44 to pass freely therethrough. From FIGS. 9 and 10 it is apparent that, upon actuation of the cylinder unit 49 in the extension and retraction directions, the clamp P comprising the jaws 55, 55' will be opened and closed, respectively, with a self-centering movement. Said jaws 55, 55' are at the same distance from the imaginary plane which is perpendicular to the rods 44, 44' and 45, 45' and which contains the axis of the shaft 10. At the other side of the turret-like gripping frame, opposite to the clamp P, there is provided a similar clamp P' which is actuated with a self-centering movement by a respective cylinder unit 49. At least the clamp P, designed to grip the empty spools, may be provided on the inner side with auxiliary wing members 57, 57' to improve the spool-gripping capability of the jaws 55, 55' and avoid any undesired movement of said spools.

With reference to FIGS. 9 and 10, it will be seen that on the portion of the rod 45' (or 44') located between the plates 42, 42' and close to the plate 42, there is frictionally mounted a sliding block 58 formed with a through hole 59 which is parallel to said rod 45' and loosely receives therethrough a pin 60 which, in this embodiment, is secured at one end to the plate 42 and is provided at the other end with an integral ring member 61 located close to said plate 42 and transversed by the rod 45'. The sliding block 58 is located between the members 61 and 42, and comprises a reference means 62 which may cooperate with a proximity sensor 162 secured to the plate 42. Upon actuation of the clamp in the closing direction, the sliding block 58 will engage the plate 42, and its reference means 62 moves past the sensor 162. Conversely, upon actuation of the clamp P or P' in the opening direction, said sliding block 58 will engage the ring member 61, and the reference means 62 will cooperate with the sensor 162. By properly adjusting these members, the sensor 162 may be caused to detect the reversal of the movement of said clamp just after a few millimeters' stroke of said jaws 55, 55'.

The robot of the invention comprises, finally, means (shown in FIG. 12) for cutting the wire when a spool has been filled and for securing to said spool, first, the leading end and, finally, the trailing end of said wire. Said means are of the type illustrated in EP Application No. A2 0142 813 and, therefore, are described herein only in connection with the parts facilitating the understanding of the operation of the robot according to the invention. Said means is mounted on the outer side of the wall 101 of the structure 1, is directed towards the side of the track 4 adjacent the aligned winding machine, and comprises a plate 63 which may be caused to slide in the direction of the arrows 64 by a guide-and-slide unit and by a fluid-operated double-acting cylinder and piston unit (not shown).

Figure 12:
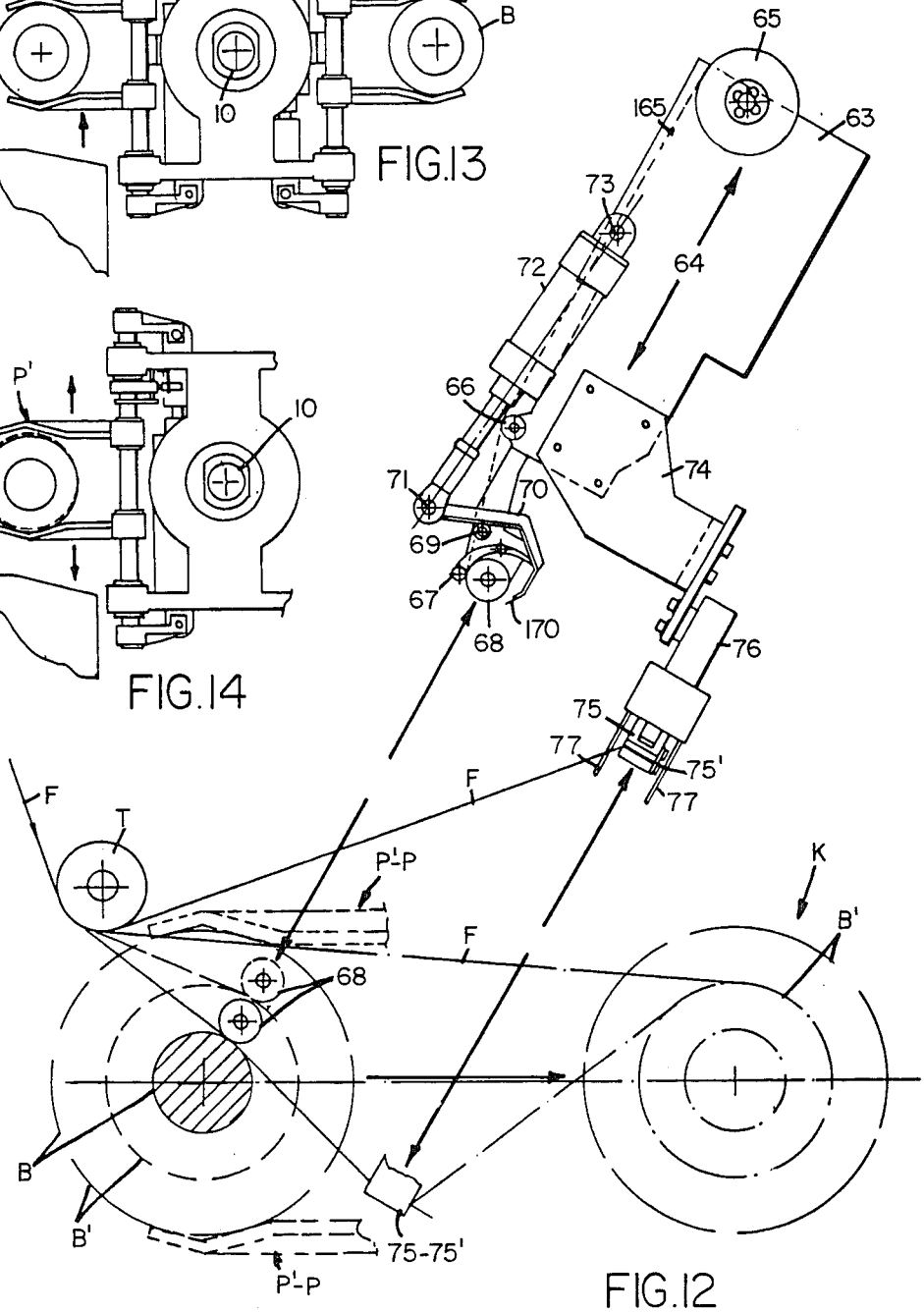
FIG. 12 is a front elevational view of the robot-supported means for cutting the wire and for securing the leading and trailing ends of said wire to the spools.

Rotatably mounted on said plate is a roll 65 of adhesive tape 165 which is passed around a small idle roller 66 to reach the nip between a pair of parallel idle rollers 67–68, the smaller roller being a spring-loaded nip-roller. The adhesive face of the tape 165 faces leftwards as seen in FIG. 12. Mounted on pivot 69 is a lever 70 equipped with cutting means 170 and pivotably connected at 71 to a pneumatic actuating cylinder 72 which, in turn, is pivoted at 73 to the plate 63. Secured to the plate 63 is a plate 74 mounting the wire holding and cutting unit 75, 75', and the pneumatic cylinder 76 actuating said unit. The numeral 77 indicates fork-shaped members for directing the wire to the unit 75, 75'.

The robot described above operates as follows. When the robot is at the parking station, i.e., at the beginning of the track 4, the shaft 10 of the turret-like frame is at the right-hand end of the slot 9. Both clamps P and P' are opened and are disposed horizontally, the clamp P' being directed towards the side of the track 4 where the winding machines are arranged. The plug member 24 of FIG. 6 is engaged in one of the holes 22, 22'. When a winding machine calls for a robot, the latter automatically picks up by means of the clamp P, an empty spool of the proper size, whereafter the drive motor 8 of FIG. 1 is activated and said robot approaches the winding machine at the maximum speed. Sensors, indicated generally by numeral 78, are mounted on the carriage 2 and, upon detecting reference means suitably arranged along the track 4, they cause the motor 8 first to decrease its speed and then to stop while, at the appropriate ti me, a pneumatic cylinder 79 (FIG. 1) is activated to insert a plug member 80 provided on said carriage 2 into a seat (not shown) formed in the base plate of the wire-winding machine to be served. The required positioning between said robot and winding machine is thus ensured.

Figure 13:
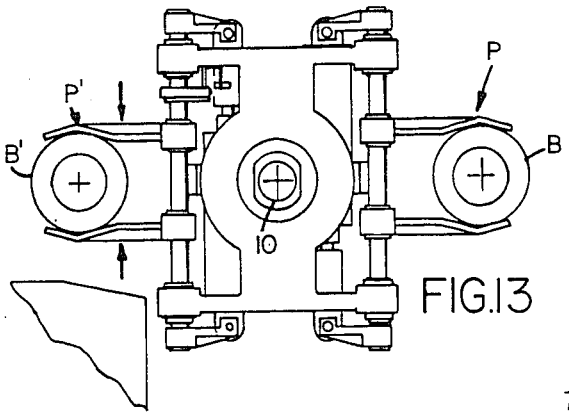
FIGS. 13 and 14 are front elevational views of the turret-like gripping frame with its clamps during different operative steps.
Figure 14:
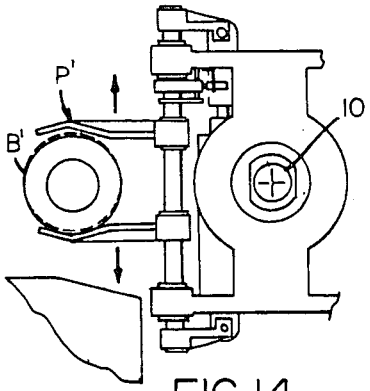

The descent of the plate 63 of FIG. 12 is then effected and the roller 68 engages the wound wire, as shown in broken lines, at the trailing end of the wire coming from the transversing device T and stopped at a pre-determined position. In this condition, the means 75, 75', 77 are not operative. The winding machine rotates the filled spool B' slowly and in a clockwise direction (as seen in FIG. 12), so that the adhesive tape may firmly secure the trailing end of the wire on the winding of the filled spool. The adhesive tape is withdrawn form its roll due to the rotation imparted to the roller 68 while engaged with the filled spool and, therefore, due to the tractive effect at the nip of the rollers 67, 68. The roller 68 is of a material which is sufficiently resilient to cause the adhesive tape to adhere firmly to the wire winding. When the trailing end of the wire has been secured, the winding machine is stopped and the plate 63 is raised while the lever 70 is activated to cut the adhesive tape by its own means 170. When the assembly of FIG. 12 has been raised completely, the cylinder 36 of FIG. 8 is activated to shift the shaft 10 leftwards (as seen in FIG. 9 to position the opened clamp P' over the filled spool B'. In the next step, the clamp P' is closed to grip the filled spool B', as shown in FIG. 13. When the jaws of the clamp P' engage the flanges of the spool B', after a delay pre-determined by suitable means, the control cylinder 49 for said clamp P' is reversely activated to open said clamp P' to a small extent (see FIG. 14) which is detected by the suitably pre-set sensor 162. Now, by its own means, the winding machine releases the filled spool B' from its center and tailstock members, so that said spool will fall onto the lower jaw of the clamp P'.

The clamp P' is then closed again, as shown in FIG. 13, and the turret-like frame is transferred horizontally back to the starting position K (FIG. 12). On completion of this step, the plate 63 moves down automatically and the wire F is caught by the means 75', 75 which, respectively, cut it and hold its new leading end, whereafter said means 75', 75 move back to the upper starting position thereof. The filled spool B' is thus ready for its final removal from the winding machine. At the appropriate time, the shaft 10 of the turret-like frame is rotated by 180° and the spools B, B' exchange their positions. Now, the empty spool B faces the winding machine. The shaft 10 is shifted horizontally leftwards, whereby the clamp P will bring the empty spool in line with the center and tailstock members of the winding machine, without interfering with the wire F which is held by the means 75 and is suitably directed upwards. In the next step, the clamp P is slightly opened, as mentioned above with reference to FIG. 14, and the empty spool is locked between the center and tailstock of the winding machine, whereafter the clamp P opens completely and the turret-like frame is moved back to its starting position by shifting horizontally its shaft 10. In the next step, the means of FIG. 12 is activated again: the plate 63 is lowered; the wire F, held by means 75, is brought into contact with the core of the empty spool B and the roller 68 with the adhesive tape is moved onto said contact area. Then, while the means 75 opens and releases the leading end of the wire F, the winding machine slowly rotates the spool B clockwise as seen in FIG. 12, whereby the leading end of the wire is secured to the core of the spool B by means of a proper length of adhesive tape 165 dispensed by the rollers 67, 68. When the wire has been secured, the plate 63 is raised and the lever 70 is activated to cut the adhesive tape by the means 170. The winding machine begins its winding cycle, and when the means of FIG. 12 has returned to its upper rest position, the robot moves back automatically to its parking station where it releases the filled spool and re-sets for a new operative cycle. In order to release the filled spool, the shaft 10 is rotated by 210° so that the clamp P' is directed downwards whereby, when it opens, the filled spool falls by gravity. During this step, the plug member 24 of FIG. 6 is engaged in the hole 23. Successively, the shaft 10 moves back to the position wherein the clamps P, P' are disposed horizontally.

I claim:

1. A robot device for loading empty spools (B) and unloading filled spools (B') into and from wire winding machines arranged in a single file on one side of a path (4), a longitudinal axis of said path (4) being substantially parallel to winding axes of said wire winding machines, said device comprising (a) a transport carriage (2) movable along said path (4) and carrying a vertical supporting structure (1);

(b) a turret-like gripping frame (41–55) cantilevered on said supporting structure (1) having an axis of rotation (10) which is horizontal and parallel to said path (4) and carrying at least one pair of diametrically opposite self-centering clamps (P, P'), each clamp being adapted to grip a spool (B, B') the axis of which is parallel to said rotational axis (10) of said gripping frame (41–55), by clamping the end flanges of said spool (B, B'); and (c) means for rotating said gripping frame (41–45) with its clamps (P, P') around its axis of rotation; locking means (21, 12) for maintaining said gripping frame on a horizontal plane, wherein said gripping frame is displaced in a direction horizontally perpendicular to said axis of rotation so as to move a clamp (P, P') on a side of said robot facing a said winding machine toward and away from said winding machine;

(d) said horizontal axis of rotation of said turret-like frame being constituted by a horizontal shaft (10) carrying said turret-like frame (41–45) with spool gripping clamps (P, P'), said shaft (10) being rotatably mounted in a supporting body member (12) which, through slide members (112, 112') slides along rectilinear horizontal guides (13—13') secured to an inner face of a front wall (101) of said support structure (1) of said robot and disposed normal to a track (4) whereon said support-structure can slide, the shifting movement of said shaft being ensured by a lever (32) pivoted on a stationary pivot and cooperating with said shaft through the intermediary of a bushing (30) and actuated by a fluid-operated double-acting cylinder and piston unit (36).

2. A robot device according to claim 1, wherein said body member (12) rotatably supporting said shaft (10) of said turret-like gripping frame with said spool-gripping clamps also supports a cylinder and piston unit (20) and guides (18—18') longitudinally slidably receiving a rack (17) which is operatively connected to a stem of said cylinder and piston unit and tangentially cooperates with a gear wheel (16) keyed on said shaft of said gripping frame for promoting rotation thereof.

3. A robot device according to claim 2, wherein said body member (12) also supports a fluid-operated double-acting cylinder and piston unit (27) acting on a plug member (24) cooperating radially with a cylindrical surface of a drum (21) which is keyed on said shaft (10) and provided on said cylindrical surface with a plurality of holes corresponding in number to the angular positions at which said shaft is to be stopped.

4. A robot device according to claim 3, wherein said drum (21) is provided with three holes (22—22'—23), two of said holes being diametrically opposite to each other while the remaining hole is spaced from the nearer of said two holes by 30° or any other small angle, the arrangement being such that when the plug member cooperates with either one of said diametrically opposite holes said spool gripping claims are disposed horizontally, while when the plug member cooperates with said remaining hole said clamp (P), loaded with a filled spool (B'), is directed downwards, so that when said clamp is opened said spool is discharged by gravity.

5. A robot device according to claim 1, wherein jaws (55—55') of said spool-gripping clamps which are mounted on said horizontal-axis gripping frame, are each secured to a pair of parallel and co-planar rods (44—44', 45—45'), the inner ones of said rods having secured thereto respective racks (50—50') in mesh with a gear wheel (51) rotatably mounted on a stationary portion (52) of said gripping frame, the arrangement being such that, by moving longitudinally at least one of said rods, said jaws of said clamp will move in a self-centering manner, the jaws of each clamp being at the same distance from a plane which is perpendicular to said pairs of rods and which contains the axis of rotation of said gripping frame.

6. A robot device according to claim 5, wherein one of the rods carrying a jaw of each clamp (P or P') of said turret-like gripping frame frictionally mounts a sliding block (58) which is slidable between two shoulder members (42–61) which are secured to said frame and are suitably spaced apart, said sliding block comprising a reference means (62) cooperating, when said clamp is opened, with a stationary sensor (162) which is used to stop said clamp in partially-opened condition on said spool, as required in the step of withdrawing a filled spool from said winding machine and in the successive step of feeding an empty spool to said winding machine.

7. A robot device according to claim 6, wherein said shaft for rotating said turret-like gripping frame and its clamps is axially hollow (38) so as to receive therethrough ducts and electric cables for operating said cylinder and piston units and sensors for operation of said gripping frame.

8. A robot device according to claim 1, wherein on said carriage structure (2) there are mounted means for cutting the wire and securing the leading and trailing ends of the wire to the spools, said cutting and securing means being mounted on a single plate (63) sliding along the front side of said carriage structure (1) of said robot.

* * * * *